US009915058B2

(12) United States Patent
McAlpine

(10) Patent No.: US 9,915,058 B2
(45) Date of Patent: Mar. 13, 2018

(54) OUTLET FOR A SANITARY UNIT

(75) Inventor: James Edward McAlpine, Glasgow (GB)

(73) Assignee: McAlpine & Co. Ltd., Glasgow (GB)

( * ) Notice: Subject to any disclaimer, the term of this patent is extended or adjusted under 35 U.S.C. 154(b) by 379 days.

(21) Appl. No.: 14/002,766

(22) PCT Filed: Mar. 1, 2012

(86) PCT No.: PCT/GB2012/000204

§ 371 (c)(1),
(2), (4) Date: Jan. 29, 2014

(87) PCT Pub. No.: WO2012/117221

PCT Pub. Date: Sep. 7, 2012

(65) Prior Publication Data

US 2014/0130899 A1 May 15, 2014

(30) Foreign Application Priority Data

Mar. 1, 2011 (GB) ..... 1103426.1

(51) Int. Cl.
*E03C 1/298* (2006.01)
*E03D 13/00* (2006.01)
*E03D 9/00* (2006.01)

(52) U.S. Cl.
CPC ..... *E03C 1/298* (2013.01); *E03D 9/00* (2013.01); *E03D 13/00* (2013.01); *E03D 13/007* (2013.01); *Y10T 137/6011* (2015.04)

(58) Field of Classification Search
CPC ..... E03C 1/281; E03C 1/288; E03C 1/298; E03C 1/104; E03C 1/106; E03D 13/007; Y10T 137/6011
USPC ..... 4/426, DIG. 13, DIG. 16, 311; 137/843, 137/844, 850, 853, 859, 852
See application file for complete search history.

(56) References Cited

U.S. PATENT DOCUMENTS 803,979 A * 11/1905 Bonnell ..... B01D 61/08 137/846
2,793,371 A * 5/1957 Levesconte ..... E03D 11/00 137/362
3,047,013 A * 7/1962 Baumbach ..... E03C 1/294 137/849
3,565,106 A * 2/1971 Baumbach ..... E03C 1/298 137/513.3

(Continued)

FOREIGN PATENT DOCUMENTS

DE 10037535 A1 3/2002
DE 20302114 U1 4/2003

(Continued)

OTHER PUBLICATIONS

Incoming Written Opinion of the ISA, PCT/GB2012/000204, dated May 9, 2012.

(Continued)

*Primary Examiner* — Erin Deery
(74) *Attorney, Agent, or Firm* — Colby Nipper

(57) ABSTRACT

A fitting (10) for a sanitary unit outlet (5) has a tubular housing (12) having an inlet (14) and an outlet (16), a grid (18) associated with the housing inlet (14) and a one-way valve (20) associated with the housing outlet (16). The housing (12), grid (18) and one-way valve (20) are removable from the sanitary unit outlet (5) as a single entity.

26 Claims, 2 Drawing Sheets

(56) References Cited

U.S. PATENT DOCUMENTS

| | | | | | |
|---|---|---|---|---|---|
| 4,594,739 | A * | 6/1986 | Watts | E03C 1/26 | 137/844 |
| 4,870,992 | A * | 10/1989 | Irwin | E03C 1/298 | 137/362 |
| 6,044,859 | A * | 4/2000 | Davis | A61M 39/24 | 137/15.19 |
| 6,401,266 | B1 * | 6/2002 | Mitchell | E03C 1/281 | 4/309 |
| 6,644,339 | B2 * | 11/2003 | Gorges | E03C 1/28 | 137/315.41 |
| 7,243,681 | B2 * | 7/2007 | Dahm | E03C 1/298 | 137/843 |
| 2002/0189675 | A1 | 12/2002 | Huber | | |
| 2004/0049846 | A1 | 3/2004 | Cornwall | | |
| 2006/0207005 | A1 * | 9/2006 | Janssen | E03C 1/281 | 4/310 |

FOREIGN PATENT DOCUMENTS

| | | | | |
|---|---|---|---|---|
| EP | 1785077 | A1 * | 5/2007 | A47K 11/12 |
| WO | 2007110595 | A2 | 10/2007 | |
| WO | 2009040524 | A1 | 4/2009 | |
| WO | 2010140761 | A2 | 12/2010 | |

OTHER PUBLICATIONS

Incoming International Search Report from IB, PCT/GB2012/000204, dated May 9, 2012.

* cited by examiner

OUTLET FOR A SANITARY UNIT

FIELD OF THE INVENTION

The present invention relates to an outlet for a sanitary unit such as a sink, bath, shower or urinal and more particularly, but not exclusively, to a fitting for a sanitary unit outlet.

BACKGROUND TO THE INVENTION

Conventional sanitary units such as urinals employ a water seal to prevent odours and noxious gases from the waste system passing through the urinal outlet into the surrounding environment. Such sanitary units require flushing on a regular basis and particularly after use, to ensure the fluid which forms the barrier is clean and odour free.

However, the costs associated with flushing, particularly in the areas where water is scarce can be considerable. Therefore there has been a movement towards low and zero water usage urinals to reduce costs. The slow and zero water usage urinals use the liquid which is being disposed of down the sanitary unit (for example urine) to form the liquid seal. Where the disposed of liquid has a smell, for example in the case of urine, a one-way valve may be used alone or in conjunction with a deodorising block which masks the smell.

One-way valves in the form of rubber diaphragm type valves have proven to be quite successful. However, removal and replacement of a worn or blocked valve involves the operator/user, in some cases, having to at least partially dismantle the outlet and put their finger inside the outlet to pull the valve out. This is both an unpleasant and time-consuming operation.

SUMMARY OF THE INVENTION

According to a first aspect of the present invention there is provided a fitting for a sanitary unit outlet, the fitting comprising:

a tubular housing having an inlet and outlet;

a grid associated with the housing inlet; and a one-way valve associated with the housing outlet;

wherein the housing, the grid and the one-way valve are removable from the sanitary unit outlet as a single entity.

By a sanitary unit it is meant, for example, a sink, bath, shower, urinal or the like and the sanitary unit outlet may comprise a waste outlet of the sink, bath, shower, urinal or the like.

In an embodiment of the present invention, a single entity which comprises, in combination, both the grid and the one-way valve permits the entity to be removed as a single unit to allow, for example, the one-way valve to be replaced. Removal can be facilitated by, for example, hooking a tool around a portion of the grid and lifting the grid, housing and valve combination out of the waste outlet. This solution allows for the one-way valve to be removed without the user having to, for example, extend their finger into the waste to remove it.

The housing may comprise an upper portion and a lower portion.

The upper portion may be associated with the grid and the lower portion may be associated with the one-way valve.

The grid may be integral with the housing. Particularly the grid may be integral with the upper housing.

The grid and the housing or upper housing may be manufactured as a single piece.

The grid and the housing or upper housing may be moulded as a single piece.

The one-way valve may be removable from the housing or lower housing. Having the one-way valve removable permits the one-way valve to be replaced, allowing the remainder of the fitting to be reused.

The housing or lower housing may be adapted to receive the one-way valve.

The housing external surface may be adapted to receive the one-way valve.

The one-way valve may be a diaphragm.

The diaphragm may be a rubber diaphragm.

The fitting may comprise a sleeve for securing the one-way valve to the housing.

The one-way valve may be sandwiched between the housing and the sleeve.

The sleeve may be releasably attachable to the housing. Releasably attaching the sleeve to the housing permits the valve to be changed by releasing the sleeve from the housing.

The sleeve may be glued, pinned, spun welded, or threadedly connected to the housing or the sleeve may form an interference fit or a snap fit with the housing.

The sleeve may be adapted to secure the one-way valve to the lower housing.

When engaged with the housing, the housing external surface and the sleeve internal surface may define a void adapted to receive a one-way valve flange. The flange may define a one-way valve inlet.

The upper housing portion and the lower housing portion may be releasably connected. Such an arrangement permits the housing to be opened to allow for cleaning. This is particularly useful when the grid and housing are unitary and the grid cannot be removed to facilitate cleaning.

The housing portions may be releasably connected by an interference fit, a threaded connection, a bayonet fitting, a snap-fit connection, or any suitable arrangement.

The housing portions may separate in response to a force being applied in a direction transverse to a fitting flow axis.

The housing portions connection may be adapted to withstand a pull force. The connection is most preferably a twist connection, such as a bayonet fitting, as fittings of this type are resistant to separation when a pull force is applied but easily separate when a twist is applied. As the fitting is to be removed from an outlet using a pull force than the requirement for a strong connection in that direction is important.

A portion of the housing or lower housing may extend into the one-way valve.

A tubular portion of the housing may extend into the one-way valve.

The tubular portion may be adapted to conserve the structural integrity of an upper portion of the one-way valve. It has been found that extending a tubular portion of the fitting into the one-way valve reduces the noise made by the one-way valve when fluid flows through it.

The housing may define a seal recess.

The seal recess may extend radially around an external surface of the housing.

The seal recess may extend radially around an external surface of the upper housing.

The seal recess may be adapted to receive an o-ring seal.

The housing may be configured to engage the sanitary unit outlet by any suitable means. The housing may be dimensioned so as to engage the sanitary unit outlet, for example by an interference fit. Alternatively, at least part of an external surface of the housing may comprise a thread configured to engage a corresponding thread on the sanitary unit outlet, where provided. The upper housing portion alone may be threaded. The lower housing alone may be threaded. Both the upper housing portion and the lower housing portion may be threaded.

According to a further aspect of the present invention there is provided a sanitary unit comprising a fitting according to the first aspect of the invention.

It should be understood that any of the features defined above in accordance with any aspect of the present invention or below in relation to any specific embodiment of the invention may be utilised, either alone or in combination, with any other defined feature, in any other aspect of the invention.

BRIEF DESCRIPTION OF THE DRAWINGS

An embodiment of the present invention will now be described with reference to the accompanying drawings in which.

DETAILED DESCRIPTION OF THE DRAWINGS

Figure 1:
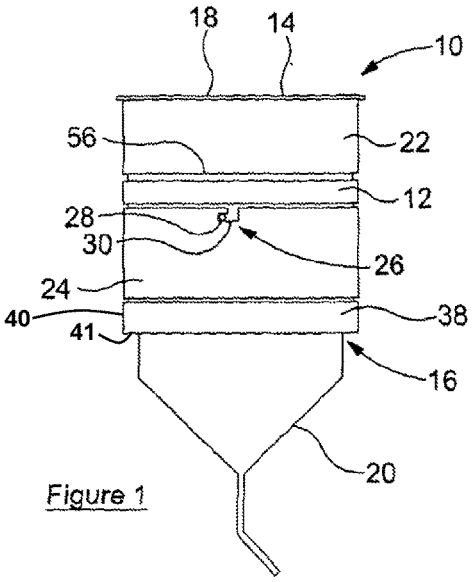
FIG. 1 is a side view of a fitting for a sanitary unit outlet, according to an embodiment of the present invention.
Figure 3:
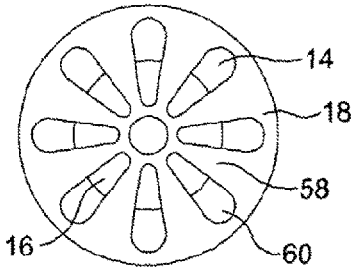
FIG. 3 is a top view of the fitting of FIG. 1.
Figure 2:
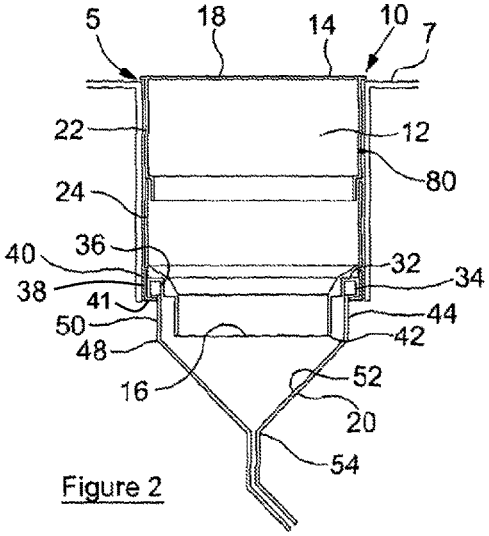
FIG. 2 is a section view of the fitting of FIG. 1.

FIGS. 1 to 3 show side, section and top views of a fitting, generally indicated by reference 10, for an outlet 5 of a sanitary unit, in this case a urinal 7, (FIG. 2) according to a first embodiment of the present invention. The fitting 10 comprises a tubular housing 12 having an inlet 14 and outlet 16, a grid 18 associated with the housing inlet 14 and a one-way valve 20 associated with the housing outlet 16.

The housing 12 comprises an upper portion 22 and a lower portion 24, the upper and lower portions 22, 24 being releasably connected together by a bayonet fitting 26, although a snap-fit connection or other suitable connection may be used where appropriate. The bayonet fitting 26 comprises a protruding element 28 defined on an external surface of the upper housing 22, the element 28 adapted to fit into a complementary slot 30 defined by the lower housing portion 24 to secure the housings 22, 24 together.

The one-way valve 20 fits in a recess 32 defined by the lower housing portion 24. The one-way valve 20 has a flange 34 which engages a recess wall 36, the wall 36 describing a diameter slightly greater than the internal diameter of the flange 34 such that the flange 34 has to be stretched slightly to fit into the recess 32. This helps retain the one-way valve on the lower housing portion 24. To secure the one-way valve 20 the lower housing portion 24, the fitting 10 further comprises a collar 38 which snapped fits onto the lower housing 24 to secure the one-way valve 20 in place.

In this example, the collar 38 is in the form of a sleeve including a tubular sleeve portion 40 for connecting the sleeve to the lower housing portion 24; and a radially inwardly extending sleeve portion 41 for securing the one-way valve 20 between the sleeve and an extension portion 42. The sleeve is distal to the inlet 14 of the tubular housing 12. The sleeve has an upper sleeve portion defined by the tubular sleeve portion 40 and a lower sleeve portion defined by the radially inwardly extending sleeve portion 41. The upper sleeve portion and the lower sleeve portion are distal to the inlet 14 of the tubular housing 12.

The housing outlet 16 extends into the one-way valve 20 and includes an extension 42. By incorporating this extension 42, it has been found that the noise made by the valve 20 as fluid flows through it is reduced. In conventional arrangements, the valve 20 can make a bubbling noise as it opens and closes. Surprisingly, it has been found that by incorporating a tubular extension 42 which extends into the upper end 44 of the valve 20, this bubbling noise can be largely eliminated. It will be noted that the tubular extension 42 is spaced away from the valve upper end 44 and the tubular extension 42 extends to a position adjacent a valve transition point 48, where an upper vertical wall of the valve 50 stops and the internal surface of the valve 52 angles towards a valve outlet to 54. It is believed that incorporating the tubular extension 42 to extend the housing 12 into the valve 20 assists in reducing the noise of the valve by delivering fluid directly onto the transition surface 52.

The grid 18 and the upper housing portion 22 are moulded as a single unit. A recess 56 is also incorporated into an external surface of the housing 12, the recess 56 being adapted to receive an O-ring seal 80 shown in FIG. 2.

When the fitting 10 is assembled, as shown in the drawings, the entire unit 10 can be lifted out of the urinal waste outlet 5 as a single entity. A simple tool such as a hook, for example, can be used to grasp one of the spokes 58 between adjacent grid apertures 60 and the application of a pull force will lift the fitting 10 out of the waste outlet 5. This allows the fitting 10 to be cleaned and, in particular, the one-way valve 20 to be replaced. Although the upper and lower housing portions 22, 24 are easily separated, the incorporation of a bayonet style connection 26 ensures that they will not separate during removal from the waste outlet 5. To separate the upper housing portion 22 from the lower housing portion 24 a twist and pull action is required whereas to remove from a waste outlet 5 only a pull the action is required.

Figure 4:
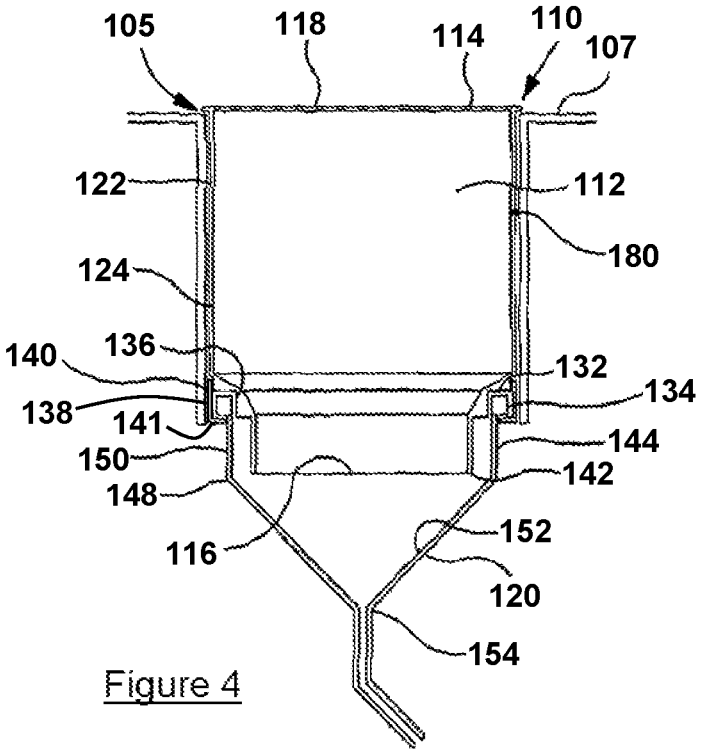
FIG. 4 is a section view of another example of a fitting for a sanitary unit outlet, according to an embodiment of the present invention.

FIG. 4 illustrates a further example of a fitting 110, which shares many features with those described in relation to the fitting 10 and as illustrated by FIGS. 1-3. Reference signs referring to features that are the same as or similar to corresponding features in FIGS. 1-3 have been incremented by 100 where appropriate, namely: outlet 105, urinal 107, tubular housing 112, inlet 114, outlet 116, grid 118, one-way valve 120, upper portion 122, lower portion 124, recess 132, flange 134, recess wall 136, collar 138, radially inwardly extending sleeve portion 141, extension 142, upper end 144, valve transition point 148, upper vertical wall 150, transition surface 152, valve outlet 154, and O-ring seal 180. In FIG. 4, the fitting 110 includes a tubular housing 112 that includes an upper housing portion 122 and a lower housing portion 124. However, in contrast to the example illustrated by FIGS. 1-3, the upper and lower housing portions 122, 124 define a one-piece construction.

Various modifications and improvements may be made to the above described embodiment without departing from the scope of the present invention. For example, the upper and lower housings may be connected by a threaded connection or a snap fit connection.

At least one of the upper housing portion and the lower housing portion may be provided with a thread or other suitable connection to permit the fitting 10 to be engaged with the outlet 5.

The invention claimed is:

1. A fitting for a sanitary unit outlet, the fitting comprising:

a tubular housing having an inlet and outlet, the tubular housing comprising:

an upper housing portion proximal to the inlet of the tubular housing and distal to the outlet of the tubular housing; and a lower housing portion proximal to the outlet of the tubular housing and distal to the inlet of the tubular housing;

a grid associated with the housing inlet;

a one-way valve associated with the housing outlet;

an extension portion configured to extend into the one-way valve; and a sleeve for securing the one-way valve to the tubular housing, wherein the one-way valve is adapted to be disposed between the sleeve and the tubular housing, wherein the sleeve comprises:

a tubular sleeve portion for connecting the sleeve to the lower housing portion; and a radially inwardly extending sleeve portion for securing the one-way valve between the sleeve and the extension portion, wherein the sleeve has an upper sleeve portion comprising the tubular sleeve portion and a lower sleeve portion comprising the radially inwardly extending sleeve portion, the upper sleeve portion and the lower sleeve portion being distal to the inlet of the tubular housing, wherein the lower housing portion of the tubular housing has an outer diameter that is the same as an outer diameter of the sleeve, and wherein the tubular housing, the grid, the one-way valve, the extension portion and the sleeve are adapted to be insertable into and removable from the sanitary unit outlet as a single entity.

2. The fitting of claim 1, wherein the upper housing portion is associated with the grid.

3. The fitting of claim 1, wherein the lower housing portion is associated with the one-way valve.

4. The fitting of claim 1, wherein the grid and the tubular housing comprise a single piece construction.

5. The fitting of claim 1, wherein the grid is integral with the upper housing portion.

6. The fitting of claim 5, wherein the grid and the upper housing portion comprise a single piece construction.

7. The fitting of claim 1, wherein the one-way valve is configured for removal from the tubular housing.

8. The fitting of claim 1, wherein the tubular housing is adapted to receive the one-way valve.

9. The fitting of claim 1, wherein the lower housing portion is adapted to receive the one-way valve.

10. The fitting of claim 1, wherein the one-way valve comprises a diaphragm.

11. The fitting of claim 1, wherein the sleeve is releasably attachable to the tubular housing to permit the one-way valve to be changed.

12. The fitting of claim 1, wherein the sleeve is connected to the tubular housing by at least one of: glue; a pin; a spun weld; a thread connection; an interference fit; and a snap fit.

13. The fitting of claim 1, wherein the sleeve is adapted to secure the one-way valve to the lower housing portion.

14. The fitting of claim 1, wherein at least one of a housing external surface and a sleeve internal surface define a void adapted to receive a flange of the one-way valve when engaged.

15. The fitting of claim 1, wherein the upper housing portion and the lower housing portion are releasably connectable.

16. The fitting of claim 1, wherein the upper housing portion and the lower housing portion are separable in response to a force being applied in a direction transverse to a fitting flow axis.

17. The fitting of claim 1, wherein the extension portion is adapted to conserve the structural integrity of an upper portion of the one-way valve.

18. The fitting of claim 1, wherein the tubular housing defines a seal recess that extends radially around an external surface of the tubular housing.

19. The fitting of claim 1, wherein the sanitary unit outlet further comprises at least one of: a sink outlet; a bath outlet; a shower outlet; and a urinal outlet.

20. The fitting of claim 1, wherein the upper housing portion is proximal to the housing inlet and distal to the housing outlet and the lower housing portion is proximal to the sleeve and distal to the housing inlet.

21. The fitting of claim 20, wherein the one-way valve is adapted to be received in a recess defined between the lower housing portion and the extension portion.

22. The fitting of claim 21, wherein the sleeve is releasably attachable to the lower housing portion to permit the one-way valve to be received in the recess.

23. The fitting of claim 21, wherein an upper portion of the one-way valve comprises a flange, the flange being adapted to be received in the recess, and the extension portion being configured to extend into the upper portion of the one-way valve.

24. A sanitary unit comprising a fitting according to claim 1.

25. A fitting for a sanitary unit outlet, the fitting comprising:

a tubular housing having an inlet and outlet, the tubular housing comprising:

an upper housing portion proximal to the inlet of the tubular housing and distal to the outlet of the tubular housing; and a lower housing portion proximal to the outlet of the tubular housing and distal to the inlet of the tubular housing;

a grid associated with the housing inlet;

a one-way valve associated with the housing outlet;

an extension portion configured to extend into the one-way valve; and a sleeve for securing the one-way valve to the tubular housing, wherein the one-way valve is adapted to be disposed between the sleeve and the lower housing portion, wherein the sleeve comprises:

a tubular sleeve portion for connecting the sleeve to the lower housing portion; and a radially inwardly extending sleeve portion for securing the one-way valve between the sleeve and the extension portion, wherein the sleeve has an upper sleeve portion comprising the tubular sleeve portion and a lower sleeve portion comprising the radially inwardly extending sleeve portion, the upper sleeve portion and the lower sleeve portion being distal to the inlet of the tubular housing, wherein the lower housing portion of the tubular housing has an outer diameter that is the same as an outer diameter of the sleeve, wherein the sleeve is releasably attachable to the lower housing portion to permit the one-way valve to be changed and to permit the one-way valve to be received in a recess defined between the lower housing portion and the extension portion, and wherein the tubular housing, the grid, the one-way valve, the extension portion and the sleeve are adapted to be insertable into and removable from the sanitary unit outlet as a single entity.

26. The fitting of claim 25, wherein the sleeve is attachable to the lower housing portion to retain the one-way valve in the recess.

* * * * *